United States Patent [19]

Lucas, Sr. et al.

[11] 3,968,879

[45] July 13, 1976

[54] SHIPPING CONTAINER AND ASSEMBLY THEREOF

[75] Inventors: George Anthony Lucas, Sr.; George Anthony Lucas, Jr., both of Delano; Louis Anthony Lucas, Santa Maria; Joseph Slapnik, Arcadia, all of Calif.

[73] Assignee: George A. Lucas & Sons, Earlimart, Calif.

[22] Filed: Nov. 12, 1973

(Under Rule 47)

[21] Appl. No.: 414,765

[52] U.S. Cl. ..... 206/509; 206/510; 206/512; 220/4 B; 220/4 E; 220/9 F

[51] Int. Cl.[2] ..... B65D 21/02; B65D 11/10; B65D 11/20

[58] Field of Search ..... 220/4 B, 4 E, 9 F; 206/509, 511, 512, 510

[56] References Cited

UNITED STATES PATENTS

| | | | |
|---|---|---|---|
| 3,103,278 | 9/1963 | Kuzma | 220/9 F |
| 3,317,073 | 5/1967 | Woerner | 220/4 B |
| 3,346,137 | 10/1967 | Ricci | 220/4 E |
| 3,371,816 | 3/1968 | Ricci | 206/511 |
| 3,396,867 | 8/1968 | Garrigg | 206/511 |
| 3,400,226 | 9/1968 | Kramreich | 220/4 B |

FOREIGN PATENTS OR APPLICATIONS

| | | | |
|---|---|---|---|
| 1,545,951 | 10/1968 | France | 206/508 |
| 1,528,159 | 4/1968 | France | 220/9 F |

*Primary Examiner*—George E. Lowrance
*Attorney, Agent, or Firm*—Flehr, Hohbach, Test, Albritton & Herbert

[57] ABSTRACT

Shipping container of the type which can be stacked with a bottom part and a top part. Cooperative mating means is carried by the top and bottom parts whereby the top part is releasably secured to the bottom part to form an enclosure within the top and bottom parts. Cooperative stacking means is carried by the top part and the bottom part which are adapted to mate with containers of the same type so that the containers may be stacked with the top part of one of the containers engaging the bottom part of another container thereby inhibiting substantial lateral and longitudinal movement of the containers with respect to each other. The cooperative stacking means includes a plurality of spaced parallel rows of recesses extending in one direction in the outer surface of one of the parts. Protrusions are formed on the outer surface of the other part and have a shape so that they are adapted to fit within the recesses.

8 Claims, 7 Drawing Figures

SHIPPING CONTAINER AND ASSEMBLY THEREOF

BACKGROUND OF THE INVENTION

This invention relates to shipping containers and particularly to shipping containers for grapes and other types of agricultural produce. In the past, boxes of various types such as wooden boxes have been utilized for the shipping of grapes and other agricultural products. Such boxes have numerous disadvantages in addition to being relatively high in cost. There is, therefore, a need for a new and improved shipping container.

SUMMARY OF THE INVENTION AND OBJECTS

The shipping container is of a type which can be stacked and comprises a bottom part and a top part. The bottom part is generally rectangular and has a bottom wall, spaced generally parallel side walls and spaced generally parallel end walls. The top part has a top wall, spaced generally side walls and spaced generally parallel end walls. Cooperative mating means is carried by the bottom and top parts whereby the top part is releasably secured to the bottom part to form an enclosed volume within the bottom and top parts. Cooperative stacking means is carried by the bottom and top parts which is adapted to mate with containers of the same type so that the containers may be stacked with the top part of one container engaging the bottom part of another container and inhibiting substantial lateral and longitudinal movement of the containers with respect to each other. The cooperative stacking means includes a plurality of spaced parallel rows of recesses extending in one direction in the outer surface of one of the parts and protrusions formed on the outer surface of the other of the parts and having a shape so that they are adapted to fit within the recesses. The top and bottom parts are provided with a plurality of spaced generally parallel slots formed on opposite sides of the respective bottom and top walls of the parts and extend through the respective wall and portions of the adjoining walls.

In general, it is an object of the present invention to provide a shipping container which can be formed of plastic.

Another object of the invention is to provide a shipping container of the above character which is stackable.

Another object of the invention is to provide a shipping container of the above character which, when stacked, the containers are interlocked with each other.

Another object of the invention is to provide a shipping container of the above character in which the shipping containers are provided with a plurality of slots which can be utilized for pre-cooling and the introduction of a preservative gas.

Another object of the invention is to provide a shipping container of the above character which, when stacked, provides air channels between the containers for the introduction of cooling air and for the introduction of a preservative gas.

Another object of the invention is to provide a shipping container of the above character in which cross stacking of the containers is possible with air channels formed between the containers.

Another object of the invention is to provide a shipping container of the above character which can be stacked on pallets and in which the pallets loaded with the containers can be stacked on top of each other.

Another object of the invention is to provide a shipping container of the above character which provides a very uniform stack.

Another object of the invention is to provide a shipping container of the above character which has a weight which is substantially less than that of conventional wooden crates or containers.

Another object of the invention is to provide a shipping container of the above character which is of substantially lesser cost than conventional wooden crates or containers.

Another object of the invention is to provide a shipping container of the above character which can be readily disposed of.

Another object of the invention is to provide a shipping container of the above character which can be readily ground up and disposed of, or alternatively, it can be burned with very little residue.

Another object of the invention is to provide a shipping container of the above character which can be readily opened and closed and which is particularly adapted for the shipping of agricultural commodities such as grapes.

Another object of the invention is to provide a shipping container of the above character which can be readily used in the field without danger of splinters and the like.

Another object of the invention is to provide a shipping container of the above character which has sufficient strength so that it can be readily stacked without any danger of crushing the fruit within the container.

Another object of the invention is to provide a shipping container of the above character which does not require the use of nails.

Another object of the invention is to provide a shipping container of the above character which minimizes "cover bruise" to the fruit within the container.

Another object of the invention is to provide a shipping container of the above character which does not remove moisture from the product contained therein.

Another object of the invention is to provide a shipping container of the above character which is white in color and does not readily absorb heat.

Another object of the invention is to provide a shipping container of the above character in which moisture will not condense on the fruit within the container until the lid is removed.

Additional features and objects of the invention will appear from the following description in which the preferred embodiment is set forth in detail in conjunction with the accompanying drawing.

DESCRIPTION OF THE PREFERRED EMBODIMENT

Figure 1:
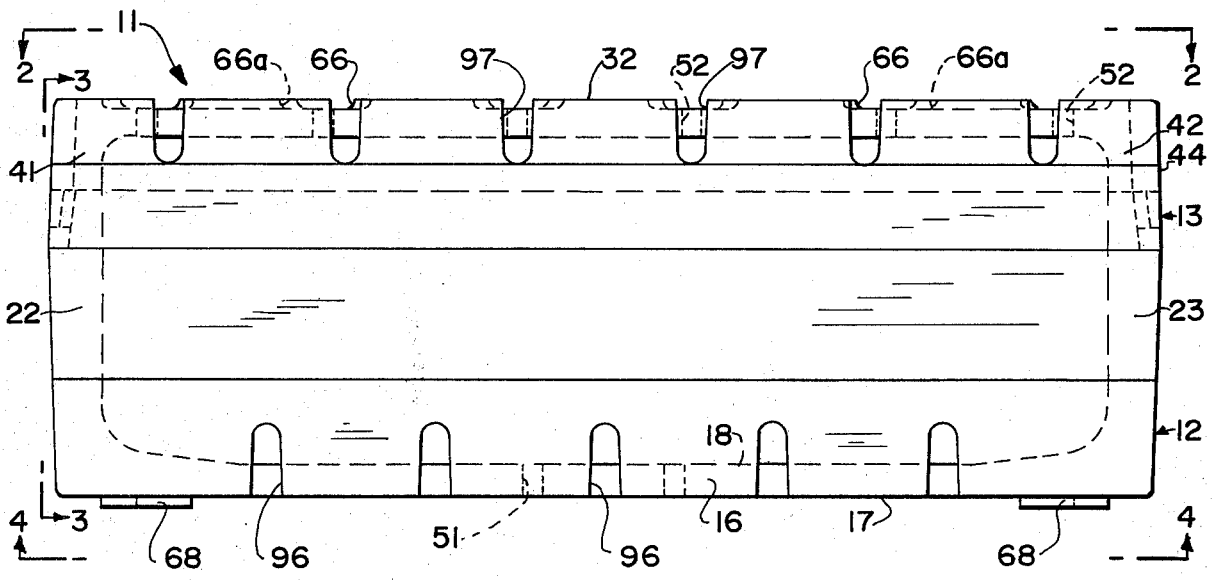
FIG. 1 is a side elevational view of the shipping container incorporating the present invention.

The shipping container 11 shown in the drawing consists of a bottom part 12 and a top part or lid 13. The bottom and top parts 12 and 13 are unitary and are preferably formed of a suitable light-weight material such as plastic. Plastics found to be suitable have been a styrofoam marketed under the trademark "XSM-1" and polystyrene. When made from such material, the bottom and top parts 12 and 13 can be readily formed in molds. The containers can have any desired color. However, white has been found to be preferable for reasons hereinafter set forth.

Figure 6:
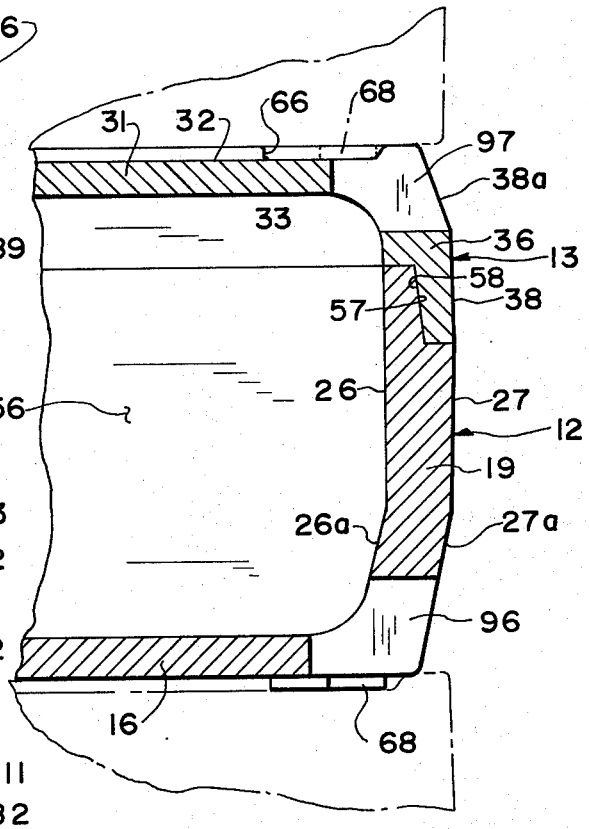
FIG. 6 is a cross-sectional view taken along the line 6—6 of FIG. 2.

The bottom part 12 consists of a bottom wall 16 which lies in a plane and has a generally planar outer surface 17 as shown in FIG. 1 and an inner surface 18 which is generally curved upwardly in its outer extremities as also shown in FIG. 1. The bottom part also consists of spaced generally parallel and generally vertical side walls 19 and 21 which adjoin the bottom wall and a pair of spaced generally parallel and vertical end walls 22 and 23 which also adjoin the bottom wall and the side walls 19 and 21 and extend generally at right angles to the side walls 19 and 21. The side walls 19 and 21 are provided with inner surfaces 26 and outer surface 27 which are generally vertical. The lower extremities of the side walls 19 and 21 are inclined inwardly, as can be seen particularly in FIG. 6, so that the bottom part of the container is provided with an inwardly tapered portion which extends the length of the bottom part on both sides of the bottom part for a purpose hereinafter described. The end walls 22 and 23 are provided with generally vertical inner surfaces 28 and generally vertical outer surfaces 29.

The top part or lid 13 consists of a top wall 31 which generally lies in a plane and is provided with an outer generally planar surface 32 and an inner generally planar surface 33. A pair of spaced generally parallel, vertically depending side walls 34 and 36 adjoin the top wall 31 and are formed integral therewith. The side walls 34 and 36 are provided with generally vertical inner surfaces 37 and outer surfaces 38. The top part or cover 13 also consists of spaced generally parallel depending end walls 41 and 42 which adjoin the bottom wall and extend at right angles to the side walls. The end walls 41 and 42 are provided with generally planar vertical inner surfaces 43 and outer surfaces 44. The outer surface 38 is provided with an upwardly and inwardly inclined surface portion **38*a*.**

Figure 4:
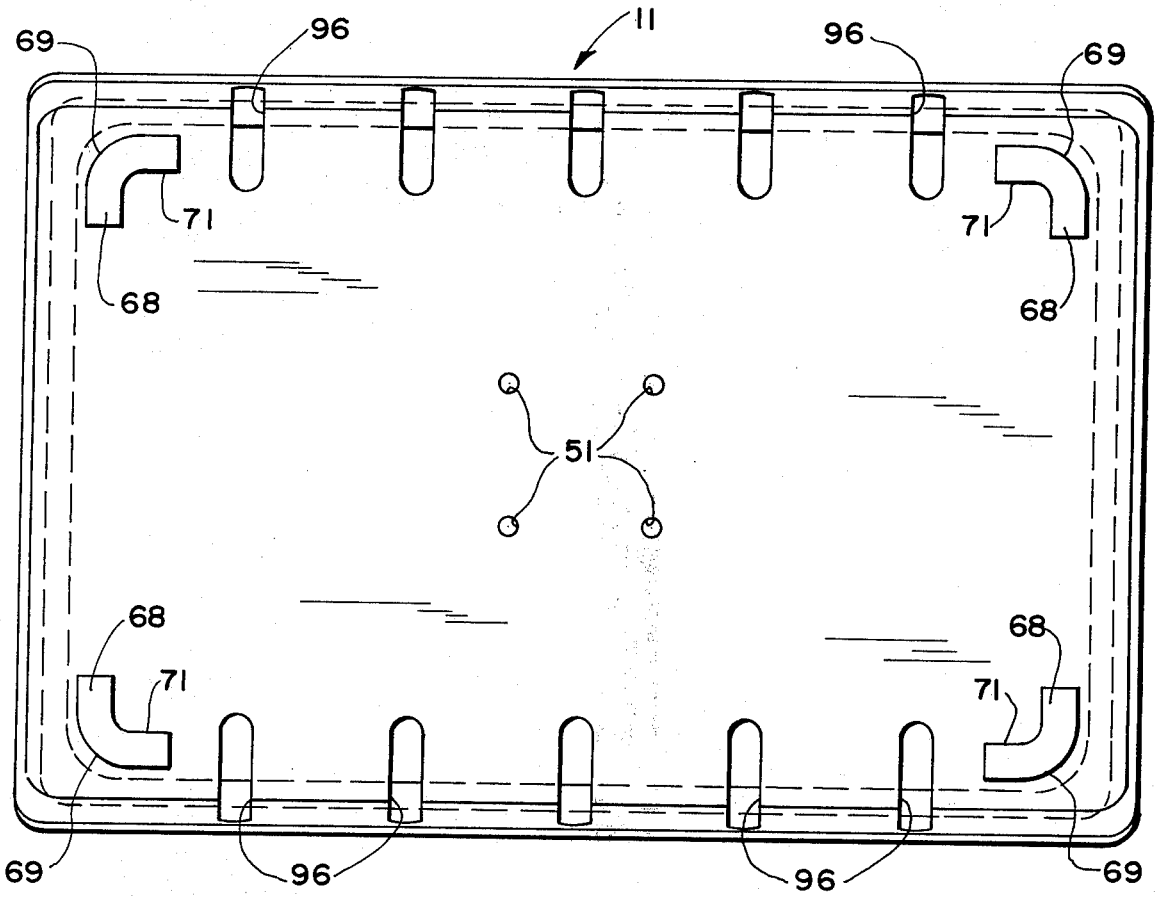
FIG. 4 is a bottom plan view of the shipping container shown in FIG. 1 looking along the line 4—4 of FIG. 1.

Four holes 51 arranged on the corners of a square are centrally disposed within the bottom wall 16 and extend through the bottom wall 16 as shown in FIG. 4. A plurality of holes 52 are provided in the top wall 31 and extend therethrough. The holes 52 are spaced apart and are provided in two parallel rows extending longitudinally of the top wall 31.

Cooperative mating means is carried by the bottom and top parts 12 and 13 whereby the top part is releasably secured to the bottom part to form an enclosed volume 56 within the bottom and top parts. This cooperative mating means takes the form of an outwardly facing recess 57 formed on the upper portion of the bottom part and extends outwardly through the outer surfaces 27 and 29 of the side walls 19 and 21 and the end walls 22 and 23. Similarly, an inwardly and downwardly facing recess 58 is formed in the lower extremity of the top part 13. This recess 58 extends through the inner surfaces 26 and 28 of the side walls 19 and 21 and the end walls 22 and 23. The recesses 57 and 58 are sized in such a manner so that they recess into each other so that smooth inner surfaces are provided for the enclosed volume 56 and smooth outer surfaces are provided for the container.

Figure 3:
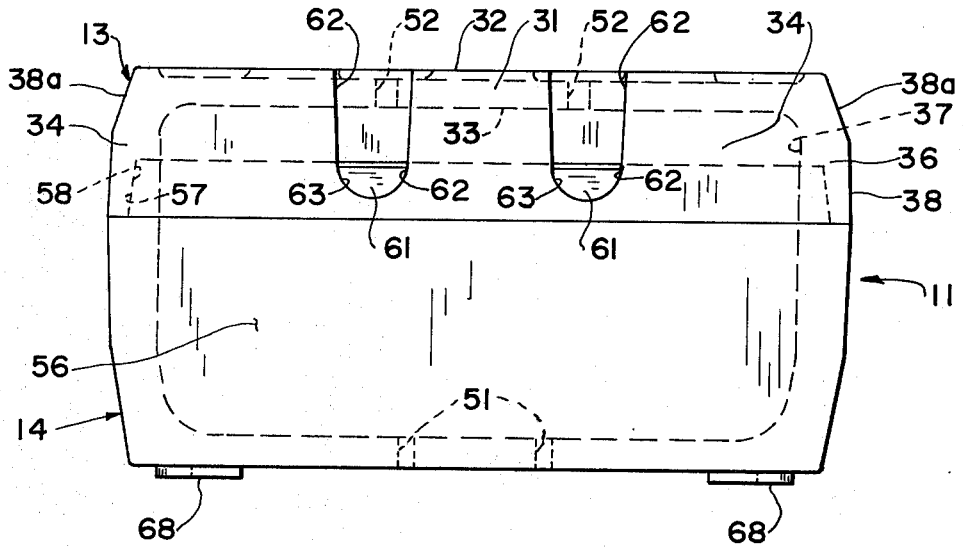
FIG. 3 is an end elevational view of the shipping container shown in FIG. 1 looking along the line 3—3 of FIG. 1.

Means is provided for releasably locking the top part 13 to the bottom part 12 and consists of a pair of spaced protrusions 61 which are formed integral with the end walls 22 and 23 of the bottom part 12 and extend into the recess 57. The protrusions 61 are in the form of semi-circular portions as shown in FIG. 3. The protrusions 61 are adapted to seat in semi-circular recesses 62 which are formed in the end walls 41 and 42 of the top part 13. As can be seen, the recesses 62 are semi-circular at their lower extremity but are elongate and extend through the top of the top part 13 so that the recesses in effect are elongate with semi-circular bottom portions. The recesses 62 are formed in such a manner so that there are provided semi-circular openings 63 which open through the lower portion of the top part 13 and into the recess 58 so that they can receive the spaced protrusions 61. Thus, it can be seen that the top part can be moved downwardly over the protrusions 61 so that the protrusions snap into place into the semi-circular holes 63 to lock the top part or cover 13 firmly in place.

In the event it is desired to remove the cover, the upper portion of one of the end walls 22 is pressed inwardly as by hand to thereby permit the protrusion 61 to clear the lower extremities of the top part 13 so that the cover can be removed. It should be appreciated that the protrusions 61 can be formed on the top part and the semi-circular holes 63 formed in the other part if desired.

Cooperative stacking means is carried by the bottom and top parts and is adapted to mate with containers of the same type so that the containers may be stacked with the top part of one container engaging the bottom part of another container and the bottom part of another container for inhibiting substantial lateral and longitudinal movement of the containers with respect to each other.

Figure 2:
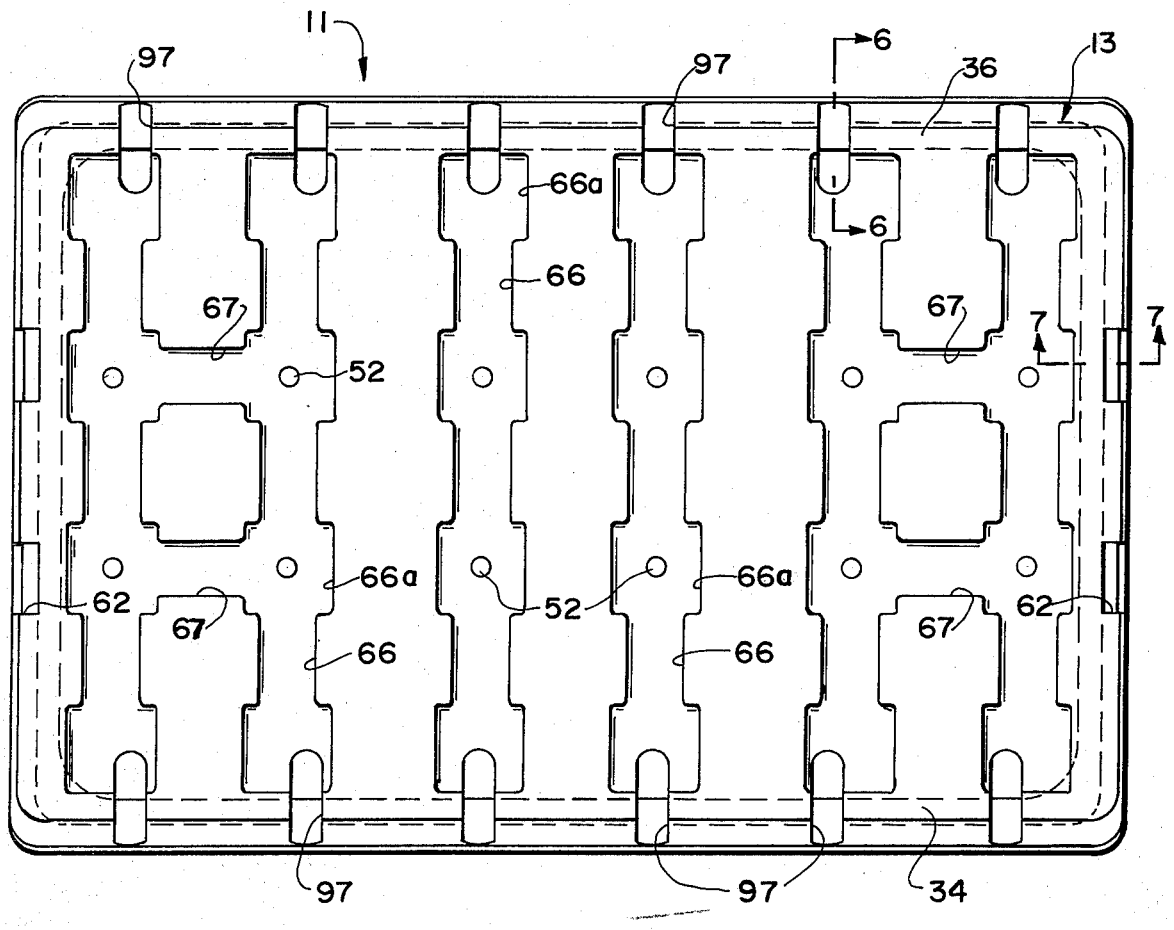
FIG. 2 is a top plan view of the shipping container shown in FIG. 1 looking along the line 2—2 of FIG. 1.

The cooperative stacking means includes a plurality of spaced parallel rows of recesses 66 extending in one direction in the outer surface of one of the parts, namely the top part 13 as shown in the drawing. For example, as shown in FIG. 2, six rows of the recesses are provided in which the recesses are equally spaced on the top wall. The recesses 66 are provided with enlarged portions **66*a* which are generally square in shape and which are spaced longitudinally of the recesses 66. Thus, as shown in the drawings, two of the enlarged portions are provided at the outer extremities of the recesses 66, whereas the other two enlarged portions are intermediate the ends of the recesses. It will be noted that the two rows of holes 52 are centrally disposed in the two enlarged portions 66*a* of the recesses 66. In addition, there are provided pairs of cross recesses 67 which extend between the inner enlarged portions of the two outermost recesses 66 on opposite ends of the top part 13.**

The cooperative stacking means includes raised portions provided on the outer surface of the bottom wall of the bottom part 12. The raised portions or protrusions 68 are generally right-angle in shape as shown in FIG. 4. As shown therein, the right-angle protrusions 68 are provided with arcuate outer surfaces 69 and arcuate inner surfaces 71. The protrusions 68 are shaped in such a way and have such a size so that they can readily fit into the enlarged portions 66*a* of recesses 66. The protrusions 68 are provided adjacent the four corners of the outer surface of the bottom wall 16 (see FIG. 4). This facilitates stacking of the containers as hereinafter described.

Figure 5:
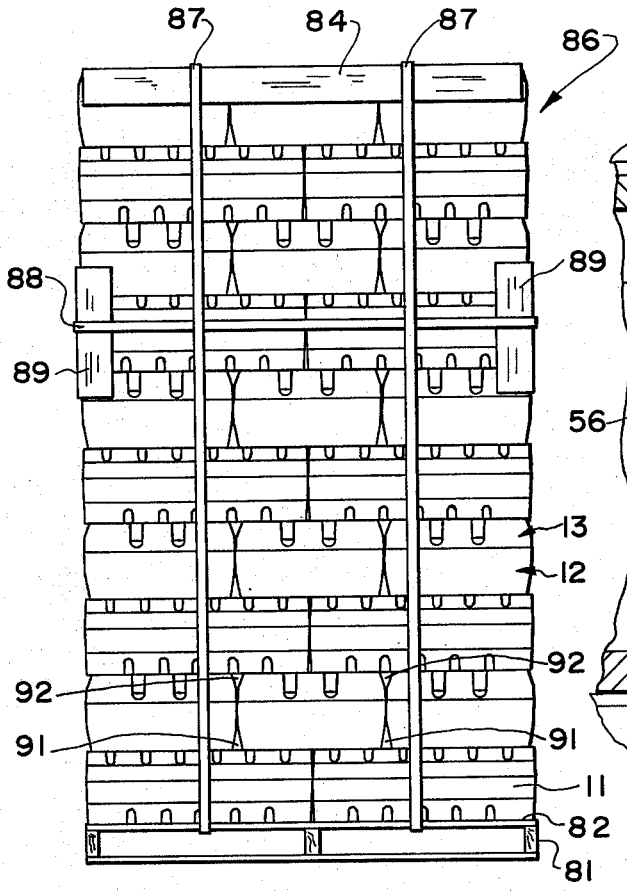
FIG. 5 is a view showing the manner in which shipping containers can be stacked on the pallet and showing the interlocking arrangement between the containers.

The containers, as hereinbefore described, are formed in such a manner so that they can readily be stacked one upon the other as, for example, upon a wood pallet 81 as shown in FIG. 5. The wood pallet 81 is of a conventional construction and is provided with a top surface 82 upon which the containers 11 can be stacked. The containers 11 can be of a suitable size such as approximately 20 inches in length and 13 inches in width, or a length approximately one and one-half times the width. The bottom part 12 has a height of approximately 6 inches and the top part 13 has a height of slightly in excess of 2½ inches. With shipping containers 11 having such dimensions, six containers may be placed in each layer of containers carried by the pallet. Thus, as shown in FIG. 5, three rows of two containers each arranged end to end are positioned on the first layer. In the second layer from the bottom of the pallet, the containers 11 are arranged at an angle of 90° with respect to the containers therebelow. In this layer there are provided three rows of two containers in each row being arranged end to end and the containers in the rows being arranged side by side in parallel rows. Similarly, in the third layer from the bottom, the containers are arranged in the same manner as they are on the bottom layer. In the fourth layer they are arranged in the same manner as the second layer, and so on until a total of nine layers is provided on the pallet. A plurality of cardboard reinforcing members 84 which are L-shaped in cross-section are provided on opposite sides of the stack 86 of shipping containers 11 provided on the pallet 81. A pair of steel straps 87 are passed over the top of the stack and through the pallet as shown in FIG. 5 to secure the stack to the pallet. An additional steel strap 89 extends around the stack approximately two-thirds of the height of the stack and engages cardboard reinforcing members 89 placed on the four corners of the stack. With such an arrangement, it can be seen that with six of the containers in each of the layers and nine layers, that 54 containers can be provided on each pallet. Since the containers are very strong, it is possible to provide palletized stacks which can be stacked one on top of the other as, for example, as many as three high without danger of crushing the shipping containers.

It should be particularly noted that when the containers are stacked together in the manner shown, the containers in the row above are cross stacked with respect to the containers below, and vice versa. Thus, the protrusions 68 on the bottom part 13 seat with the enlarged portion 66*a* of the recesses 66 of the container therebelow. The protrusion on one corner of the bottom part 12 will fit into the enlarged portion 66*a* of one corner of the top part 13 of the container therebelow. The other protrusion 61 of the container above will fit into the enlarged portion 66*a* of the fourth recess counting from the left of the top part 13 of the container therebelow. The protrusions 61 are generally in the form of a right angle and, therefore, are adapted to fit within the square enlarged portion 66*a*. The next container to the right as viewed in FIG. 5 has the protrusion 61 of its bottom part 12 seated in the enlarged portion 66*a* of the second recess 66 from the right as viewed in FIG. 5 of the container therebelow. The other protrusion on the bottom part 12 of the container above fits into the second recess from the left of the next container in the row below. The third container in the second row from the bottom has its protrusions 61 fitting into the fourth and first recesses 66 counting from the right as viewed in FIG. 5.

The same interlocking arrangement is carried out with the remainder of the containers in the first and second levels of the stack. Thus, there are provided three rows of two containers which are arranged end to end in the first stack and three rows of containers arranged end to end extending in the transverse direction or crosswise direction. The other ends of the containers extending in the transverse direction have their protrusions 61 extending into the second enlarged portions 66*a* and the recesses counting from the forward edge of the container to the rear of the container as shown in FIG. 5 in the first level of containers. In effect, it can be appreciated that the arrangement would be identical to that which is shown with respect to the second and third level of containers. Thus, the manner in which the containers interlock with each other as viewed from the right-hand side of FIG. 5 can readily be imagined merely by going down one layer or going up one layer from the arrangement shown in FIG. 5.

In this way, it can be readily seen that a compact four-sided stack of containers can easily be provided which can be banded together on a pallet as shown in FIG. 5 with the stack being generally square in cross-section and having four relatively flush surfaces. The stack is very stable and compact.

In addition, even though a relatively compact stack is provided which has great stability because of the cross stacking of every other row of the containers, adequate air channels are provided between the containers so that in effect every container is like an outside container. This is accomplished because of the tapered side walls provided on the bottom and top parts which form air channels 91 and 92 between the bottom part 12 and the top part 13, respectively, as shown in FIG. 5, between adjacent containers on the same level which are stacked side by side as, for example, the second, fourth, sixth and eighth layers of containers looking from the side shown in FIG. 5 and the first, third, fifth, seventh and ninth rows looking from either the left or right-hand side of the stack as shown in FIG. 5. These air channels 91 and 92 extend completely through the stack so that there is ready access for air to all side walls of all of the containers in the stack.

The air channels 91 are in communication with a plurality of spaced slots 96 in each container 11 which open through the bottom wall 16 and outwardly through the tapered outer surface 27*a* of the side wall 19 into the air channel and into the enclosed volume 56 within the container 11. There are provided two parallel rows of spaced slots on opposite sides of the bottom part of each of the shipping containers. Similarly, there are provided a plurality of spaced slots 97 on opposite sides of the cover or top part 13. These slots 97 open up through the outer surface 32 of the top wall 31 and the tapered surface 38*a* of the side walls 34 and 36 of the top part 13. These slots 97 open into the air channels 92. It also should be noted, as shown in FIG. 2, that the slots 97 open into the recesses 66 so that air can pass to the recesses 66 and into the holes 52. In this manner it can be seen there is ready and adequate air circulation between the interior of the containers and the air channels 91 and 92 on opposite sides of the containers.

The use of the containers may now be briefly described as follows. Let it be assumed that it is desired to utilize the containers for the packing and shipping of grapes. When such is the case, the containers are taken to the field and are given to the pickers where they are filled with grapes by the pickers. It has been found that the containers are very satisfactory to the pickers because they are very light in weight. In addition, the pickers do not get splinters from them as is the case with wooden boxes which have been utilized in the past. Since the containers are white, they have a lesser tendency to absorb heat and, therefore, will stay cooler in the field than wooden boxes. Since the grapes before they are picked are normally in the shade of the leaves of the grape vine, the grapes when placed in the containers will be kept cooler and, therefore, there will be less damage to the grapes.

As soon as the bottom part 12 of the shipping container has been filled with grapes by the picker, a cover or top part 13 is placed over the grapes and over the bottom part so that the outer end walls 41 are cammed outwardly over the spaced protrusions 61 formed on the bottom part until the protrusions 61 snap into engagement with the semi-circular holes 63 provided in the top part 13. Thus, it can be seen that the container can be readily closed with very little effort and without the use of nails and the like which are normally required with wooden boxes. Since the boxes are white, the grapes will have a tendency to stay cooler. The construction of the cover or the top part of the container 13 is such that there is very little, if any, "cover damage" to the grapes in the container when the top part or cover is put in place.

As soon as the containers have been filled, they can be palletized in the field in the manner shown in FIG. 5, or they can be taken to a packing shed where they can be palletized. The pallets with the containers thereon are then rapidly moved into refrigerated areas of the warehouses where they are precooled for a period ranging from 24 hrs. to 36 hrs. to bring the temperature of the grapes down to approximately 34°F. During this same time, a preservative gas is introduced into the containers to prevent decay of the grapes.

Because of the air channels 91 and 92 which are provided between the containers after they have been palletized, cooling air can be readily introduced into all of the containers through slots 96 and 97. Thus, it is possible to readily cool the grapes in the containers even though the containers have been palletized.

After the grapes have been pre-cooled, they can be placed in holding rooms at 32°F. The containers can remain palletized so that they can be readily shipped from one location to another. The air channels 91 and 92 provide adequate ventilation at all times for the grapes in the containers.

Figure 7:
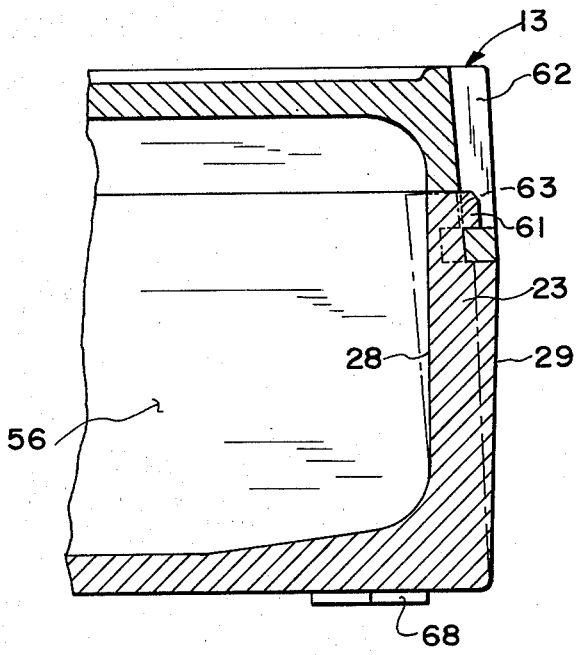
FIG. 7 is a cross-sectional view taken along the line 7—7 of FIG. 2.

From the foregoing, it can be seen that uniform stacks of containers can be provided on shipping pallets. Such containers have a lesser weight than wooden boxes and also have a lower cost. They also can be readily closed as hereinbefore described. To open the same, it is merely necessary to press inwardly on the upper extremity of the ends of the bottom part 12 as shown in FIG. 7 so that the protrusions 61 carried by the end walls of the bottom part will clear the semi-circular holes 63 provided in the end walls of the top part 13 whereby the top part can be lifted upwardly to open the container. After the grapes have been removed from the container, the container can be disposed of. It is relatively easy to dispose of because it can be ground up and then disposed of, or alternatively, it can be burned with very little residue.

It has been found that the containers are also advantageous over wooden boxes in that the containers do not absorb moisture from the grapes which the wooden boxes have a tendency to do.

Because of the cross stacking which is permitted by the construction of the containers, the containers are more easily and less expensively palletized; for example, less banding is required than is the case with wooden boxes. As can be seen from the drawing, only two vertically extending bands are required and one horizontally extending band. The containers also can be readily stacked without any danger of crushing the fruit within the containers.

It has been found that the containers are also advantageous in that the grapes do not have a tendency to sweat until the top part or cover is removed. This is probably due to the fact that the container is formed of a material which is a relatively good insulator. This insulating quality is advantageous in the field because in combination with the white color, the interior of the container will remain cooler.

It will be apparent from the foregoing that there has been provided a container which is particularly adaptable for the shipping of fruit, vegetables and the like. It is relatively light in weight, inexpensive and can be readily used in the field. In addition, it can be readily palletized and is particularly useful for pre-cooling of the fruit or vegetables in the container and for introducing preservative gas into the fruit or vegetables.

We claim:

1. A shipping container of the type which can be stacked comprising a bottom part and a top part formed of a plastic foam material, said bottom part having a bottom wall, spaced generally parallel side walls and spaced generally parallel end walls, said side walls of said bottom part having vertical outer surfaces with tapered surfaces extending inwardly adjacent the lower portions thereof, said side walls of said bottom part having openings extending through the side walls of the bottom part and the tapered surfaces of the side walls of the bottom part, said tapered surfaces on the side walls of the bottom part having a height so that the openings in the bottom part extend solely through the tapered surfaces of the side walls of the bottom part, said top part having a top having a top wall, spaced generally parallel side walls and spaced generally parallel end walls, said side walls of said top part having vertical outer surfaces with tapered surfaces extending inwardly adjacent the upper portions thereof, said side walls of said top part having openings extending through the side walls of the top part and the tapered surfaces of the side walls of the top part, said tapered surfaces on the side walls of the top part having a height so that the openings in the top part extend solely through the tapered surfaces of the side walls of the top part, cooperative mating means carried by the bottom and top parts whereby the top part is releasably secured to the bottom part to form an enclosed volume within the bottom and top parts which is ventilated by the openings in bottom and top parts, cooperative stacking means carried by the bottom and top parts adapted to mate with containers of the same type so that the containers may be stacked with the top part of one container engaging the bottom part of another container and inhibiting substantial lateral and longtitudinal movement of the containers with respect to each other so that the containers are interlocked when stacked one on top of the other or when they are cross stacked, said cooperative stacking means including a plurality of spaced parallel rows of recesses in the outer surface of one of the parts, and protrusions formed on the outer surface of the other of the parts and having a shape so that they are adapted to fit within said recesses.

2. A shipping container as in claim 1 wherein at least two of said rows of recesses are provided in said outer surface.

3. A shipping container as in claim 1 wherein said cooperative mating means is in the form of an outwardly facing recess extending around said one part near the outer margin thereof and an inwardly facing recess extending around the outer extremity of the top part so that said top and bottom parts can be fitted together with the outer surfaces of the end and side walls being substantially flush.

4. A shipping container as in claim 3 wherein said cooperative mating means includes a pair of spaced protrusions carried on opposite walls of one of the parts and spaced holes carried by corresponding walls of the other part and adapted to be engaged by said protrusions.

5. A shipping container as in claim 1 wherein the outer upper surface of the top part is provided with a plurality of spaced channels into which the openings in the top part extend.

6. In a stack of shipping containers with each of the containers having a length substantially greater than the width, comprising: a bottom part and a top part formed of a plastic foam material, said bottom part having a bottom wall, spaced generally parallel side walls and spaced generally parallel end walls, said side walls of said bottom part having vertical outer surfaces with tapered surfaces extending inwardly adjacent the lower portions thereof, said side walls of said bottom part having openings extending through the side walls of the bottom part and the tapered surfaces of the side walls of the bottom part, said tapered surfaces on the side walls of the bottom part having a height so that the opening in the bottom part extend solely through the tapered surfaces of the side walls of the bottom part, said top part having a top wall, spaced generally parallel side walls and spaced generally parallel end walls, said side walls of said top part having vertical outer surfaces with tapered surfaces extending inwardly adjacent the upper portions thereof, said side walls of said top part having openings extending through the side walls of the top part and the tapered surfaces of the side walls of the top part, said tapered outer surfaces on the side walls of the top part having a height so that the openings in the top part extend solely through the tapered surfaces of the side walls of the top part, cooperative mating means carried by the bottom and top parts whereby the top part is releasably secured to the bottom part to form an enclosed volume within the bottom and top parts which is ventilated by the openings in bottom and top parts, cooperative stacking means including a plurality of spaced parallel rows of recesses extending in one direction in the outer surface of one of the parts, and protrusions formed on the outer surface of the other of the parts and having a shape so that they are adapted to fit within said recesses, said containers being stacked in layers with the containers in one layer being disposed end to end in one direction and side by side in another direction with the containers in the row above being stacked crosswise of the containers below so that for each two containers stacked end to end in the row below, there are three containers positioned side by side in the layer above to provide a stack which is substantially squarer in cross-section with generally flush outer sides, said cooperative stacking means of the containers inhibiting substantial lateral and longitudinal movement of the containers with respect to each other, said tapered surfaces on said side walls of said bottom and top parts being generally symmetrical and adjacent the top and bottom parts between the stacked containers which are in communication with said openings in said top and bottom parts so that the enclosed volumes in the containers are ventilated.

7. A stack as in claim 6 wherein the containers have a length approximately one and one-half times the width of the container.

8. A stack as in claim 6 wherein at least one of the cross-wised stacked containers is utilzed for interlocking the ends of the containers therebelow.

* * * * *

UNITED STATES PATENT AND TRADEMARK OFFICE

CERTIFICATE OF CORRECTION

PATENT NO. : 3,968,879

DATED : July 13, 1976

INVENTOR(S) : George A. Lucas, Sr.; George Anthony Lucas Jr.; Louis Anthony Lucas; and Joseph Slapnik It is certified that error appears in the above-identified patent and that said Letters Patent are hereby corrected as shown below:

On the title page, the Assignee should read:

-- said George A. Lucas, Sr.; George A. Lucas, Jr.; and Louis A. Lucas assignors to George A. Lucas & Sons, Earlimart, Calif. --

Signed and Sealed this

*Twenty-fourth* Day of *July 1979*

[SEAL]

*Attest:*

*Attesting Officer*

LUTRELLE F. PARKER

*Acting Commissioner of Patents and Trademarks*